US009546627B2

(12) United States Patent
Okamoto et al.

(10) Patent No.: US 9,546,627 B2
(45) Date of Patent: Jan. 17, 2017

(54) SUPPORT STRUCTURE OF DIRECT FUEL INJECTION VALVE

(71) Applicant: KEIHIN CORPORATION, Shinjuku-ku, Tokyo (JP)

(72) Inventors: Atsushi Okamoto, Tochigi (JP); Atsushi Kamahora, Tochigi (JP); Junichi Miyashita, Tochigi (JP); Noriaki Sumisya, Tochigi (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 14/057,144

(22) Filed: Oct. 18, 2013

(65) Prior Publication Data

US 2014/0123933 A1 May 8, 2014

(30) Foreign Application Priority Data

Nov. 2, 2012 (JP) ..... 2012-242534

(51) Int. Cl.
*F02M 39/00* (2006.01)
*F02M 51/06* (2006.01)
*F02M 61/14* (2006.01)

(52) U.S. Cl.
CPC ..... *F02M 39/00* (2013.01); *F02M 51/0671* (2013.01); *F02M 61/14* (2013.01); *F02M 2200/851* (2013.01); *F02M 2200/855* (2013.01)

(58) Field of Classification Search
CPC .... F02M 61/14; F02M 69/465; F02M 61/145; F02M 2200/858; F02M 61/168; F02M 21/0281; F02M 35/048; F02M 69/042; F02M 2200/856; F02M 2200/853; F02M 2200/857
(Continued)

(56) References Cited

U.S. PATENT DOCUMENTS 4,974,312 A * 12/1990 Yokoyama ..... F02M 51/0682 239/585.4
4,993,390 A 2/1991 Ono et al.
(Continued)

FOREIGN PATENT DOCUMENTS

CN 2651457 Y 10/2004
CN 102046958 A 5/2011
(Continued)

OTHER PUBLICATIONS

Official Communication dated Sep. 1, 2015 related to corresponding Chinese Patent Application No. 201310529466.6.
(Continued)

*Primary Examiner* — Hung Q Nguyen
*Assistant Examiner* — Brian P Monahon
(74) *Attorney, Agent, or Firm* — Carrier Blackman & Associates, P.C.; William D. Blackman; Jingli Wang

(57) ABSTRACT

In a support structure of a direct fuel injection valve capable of supporting a fuel injection valve stably for a long period of time, a valve housing is made of a metal and is provided with a first load bearing portion which is to be supported by an engine in an axial direction of the valve housing, a rear end portion of the fixed core is provided with a second load bearing portion which is to be supported by a resilient holding member in the axial direction, and the first and second load bearing portions are held between the engine and the resilient holding members with a forward set load applied to the resilient holding member by a fuel distribution pipe fitted to a fuel inlet tube and fixed to the engine.

2 Claims, 3 Drawing Sheets

(58) Field of Classification Search
USPC ..... 239/585.1–585.5; 251/129.21, 129.22, 251/129.15
See application file for complete search history.

(56) References Cited

U.S. PATENT DOCUMENTS

| | | | | |
|---|---|---|---|---|
| 5,058,554 | A | 10/1991 | Takeda et al. | |
| 5,074,269 | A | 12/1991 | Herbon et al. | |
| 5,724,946 | A | 3/1998 | Franchitto | |
| 5,820,168 | A | 10/1998 | De Giacomoni | |
| 5,970,953 | A * | 10/1999 | Lorraine et al. | 123/470 |
| 6,148,797 | A | 11/2000 | Gmelin | |
| 6,199,538 | B1 | 3/2001 | Aota et al. | |
| 6,260,404 | B1 * | 7/2001 | Aota et al. | 73/1.36 |
| 6,276,339 | B1 | 8/2001 | Shebert, Jr. et al. | |
| 6,441,335 | B1 * | 8/2002 | Nagaoka | B23K 15/008 219/121.14 |
| 6,481,420 | B1 | 11/2002 | Panasuk et al. | |
| 6,481,646 | B1 * | 11/2002 | Hornby | F02M 51/005 123/470 |
| 6,561,168 | B2 * | 5/2003 | Hokao | F02M 51/0682 123/41.31 |
| 7,210,462 | B2 | 5/2007 | Scheffel et al. | |
| 7,406,946 | B1 | 8/2008 | Watanabe et al. | |
| 7,527,038 | B2 * | 5/2009 | Watanabe et al. | 123/470 |
| 7,802,559 | B2 | 9/2010 | Furst et al. | |
| 7,931,007 | B2 * | 4/2011 | Fischer et al. | 123/456 |
| 8,707,930 | B2 | 4/2014 | Bolz et al. | |
| 8,757,128 | B2 | 6/2014 | Fischer et al. | |
| 9,032,934 | B2 | 5/2015 | Nakamura et al. | |
| 9,109,563 | B2 | 8/2015 | Roseborsky et al. | |
| 9,115,679 | B2 | 8/2015 | Roseborsky et al. | |
| 9,212,641 | B2 | 12/2015 | Nakamura et al. | |
| 2002/0043575 | A1 * | 4/2002 | Sekine | F02M 51/0671 239/585.1 |
| 2003/0172911 | A1 * | 9/2003 | Nishiwaki et al. | 123/456 |
| 2006/0191511 | A1 * | 8/2006 | Mifuji | F02M 61/162 123/305 |
| 2006/0208108 | A1 * | 9/2006 | Kato | F02M 61/184 239/533.3 |
| 2007/0007477 | A1 * | 1/2007 | Hamada | F02M 51/005 251/129.15 |
| 2007/0215114 | A1 * | 9/2007 | Akabane | F02M 61/1853 123/445 |
| 2008/0302336 | A1 | 12/2008 | Fuerst et al. | |
| 2009/0007886 | A1 * | 1/2009 | Akabane | F02M 51/005 123/476 |
| 2009/0184512 | A1 | 7/2009 | Giorgetti et al. | |
| 2009/0301442 | A1 * | 12/2009 | Reiter | 123/490 |
| 2010/0012093 | A1 | 1/2010 | Pepperine et al. | |
| 2010/0300406 | A1 | 12/2010 | Harvey et al. | |
| 2012/0031997 | A1 | 2/2012 | Harvey et al. | |
| 2014/0123933 | A1 | 5/2014 | Okamoto et al. | |
| 2014/0123952 | A1 | 5/2014 | Yasuda et al. | |
| 2015/0013643 | A1 | 1/2015 | Serra et al. | |

FOREIGN PATENT DOCUMENTS

| | | | |
|---|---|---|---|
| CN | 102076955 | A | 5/2011 |
| CN | 102734027 | A | 10/2012 |
| DE | 102005013981 | A1 | 9/2006 |
| DE | 102005020380 | A1 | 11/2006 |
| DE | 10 2010 017725 | A1 | 1/2012 |
| EP | 1 892 408 | A1 | 2/2008 |
| JP | 2001-511867 | A | 8/2001 |
| JP | 2007298066 | A | 11/2007 |
| JP | 2010-168964 | A | 8/2010 |
| JP | 2010-168965 | A | 8/2010 |
| JP | 2011-501020 | A | 1/2011 |
| JP | 2011-099456 | A | 5/2011 |
| JP | 2011-196293 | A | 10/2011 |

OTHER PUBLICATIONS

PTO-892 form issued Jan. 14, 2016 for co-pending U.S. Appl. No. 14/069,796.

Office Action issued in co-pending patent U.S. Appl. No. 14/069,796 and dated May 19, 2016.

Official Communication dated Sep. 1, 2015 issued over the corresponding CN Patent Application 201310537588.X of co-pending U.S. Appl. No. 14/069,796.

Official Communication issued in corresponding German Application Serial No. 10 2013 221 694.7 dated Oct. 19, 2015.

Official communication (Decision of Granting a Patent) issued to the corresponding Japanese patent application 2012-242534, dated May 18, 2016.

Office Action issued in the corresponding Japanese Patent Application 2012-243865 dated Jun. 29, 2016 of co-pending U.S. Appl. No. 14/069,796.

* cited by examiner

SUPPORT STRUCTURE OF DIRECT FUEL INJECTION VALVE

BACKGROUND OF THE INVENTION

Field of the Invention

The present invention relates to an improvement of a support structure of a direct fuel injection valve comprising: a valve housing including a valve seat at a front end thereof; a fixed core provided to be connected to a rear end of the valve housing; a fuel inlet tube continued from a rear end of the fixed core; a movable core opposed to an attraction surface of a front end of the fixed core; a coil provided around an outer periphery of the fixed core; a valve body housed in the valve housing and configured to operate in cooperation with the valve seat; a coil housing having a front end bonded to the valve housing, and housing the coil therein; and a cover layer made of a synthetic resin and formed by molding to extend from the coil housing to the fixed core, in which a fuel is directly injected to a combustion chamber of an engine when the valve body is opened with the coil energized to cause the fixed core to attract the movable core.

Description of the Related Art

As such a support structure of a direct fuel injection valve, there has been heretofore known a structure, as disclosed in Japanese Patent Application Laid-open No. 2011-99456, in which a valve housing is provided with a first load bearing portion supported by an engine in an axial direction of the valve housing, a rear end potion of a cover layer made of a synthetic resin is provided with a second load bearing portion supported by a resilient holding member in the axial direction, and the first and second load bearing portions are held between the engine and the resilient holding member with a forward set load applied to the resilient holding member by a fuel distribution pipe fitted to a fuel inlet tube and fixed to the engine.

SUMMARY OF THE INVENTION

In the above support structure of a direct fuel injection valve, the set load applied to the resilient holding member is very high because of the necessity to withstand the high pressure of the combustion chamber of the engine. In the conventional structure, however, the rear end portion of the cover layer made of the synthetic resin is provided with the second load bearing portion which is to be supported by the resilient holding member in the axial direction, and the high set load applied to the resilient holding member causes the cover layer to undergo plastic deformation over a long period of time. The cover layer thus deformed may lower the set load of the resilient holding member and consequently make the supporting of the fuel injection valve unstable.

The present invention has been made in view of the above circumstances, and has an objective to provide a support structure of a direct fuel injection valve capable of supporting a fuel injection valve stably for a long period of time.

In order to achieve the object, according to a feature of the present invention, there is provided a support structure of a direct fuel injection valve comprising: a valve housing including a valve seat at a front end thereof; a fixed core provided to be connected to a rear end of the valve housing; a fuel inlet tube continued from a rear end of the fixed core; a movable core opposed to an attraction surface of a front end of the fixed core; a coil provided around an outer periphery of the fixed core; a valve body housed in the valve housing and configured to operate in cooperation with the valve seat; a coil housing having a front end bonded to the valve housing, and housing the coil therein; and a cover layer made of a synthetic resin and formed by molding to extend from the coil housing to the fixed core, in which a fuel is directly injected to a combustion chamber of an engine when the valve body is opened with the coil energized to cause the fixed core to attract the movable core, wherein the valve housing is made of a metal and is provided with a first load bearing portion which is to be supported by the engine in an axial direction of the valve housing, a rear end portion of the fixed core is provided with a second load bearing portion which is to be supported by a resilient holding member in the axial direction, and the first and second load bearing portions are held between the engine and the resilient holding members with a forward set load applied to the resilient holding member by a fuel distribution pipe fitted to the fuel inlet tube and fixed to the engine.

It should be noted that the first load bearing portion and the second load bearing portion correspond to a yoke portion 4*a* of a magnetic cylindrical body and a rear end surface 6*c* of a fixed core 6, respectively, in the below-described embodiment of the present invention.

According to the aspect of the present invention, the valve housing made of the metal is provided with the first load bearing portion which is to be supported by the engine in the axial direction of the valve housing, the rear end portion of the fixed core is provided with the second load bearing portion which is to be supported by the resilient holding member in the axial direction, and the first and second load bearing portions are held between the engine and the resilient holding members with the forward set load applied to the resilient holding member by the fuel distribution pipe fitted to the fuel inlet tube and fixed to the engine. Thus, the valve housing and the fixed core being entirely metallic members are present between the first and second load bearing portions. Even when a high set load of the resilient holding member continuously acts on these metallic members, the metallic members are unchanged in shape and thus the set load of the resilient holding member is also unchanged. Hence, the fuel injection valve can be stably supported for a long period of time. On the other hand, the cover layer formed by molding on the coil housing and the fixed core is placed on inner sides of the first and second load bearing portions and does not receive the set load of the resilient holding member. Thus, the cover layer is free from a deformation due to the set load and thereby can secure the sealing performance on the coil hosing and the fixed core.

The above and other objects, characteristics and advantages of the present invention will be clear from detailed descriptions of the preferred embodiment which will be provided below while referring to the attached drawings.

DESCRIPTION OF THE PREFERRED EMBODIMENT

Hereinafter, an embodiment of the present invention is described based on the accompanying drawings.

Figure 1:
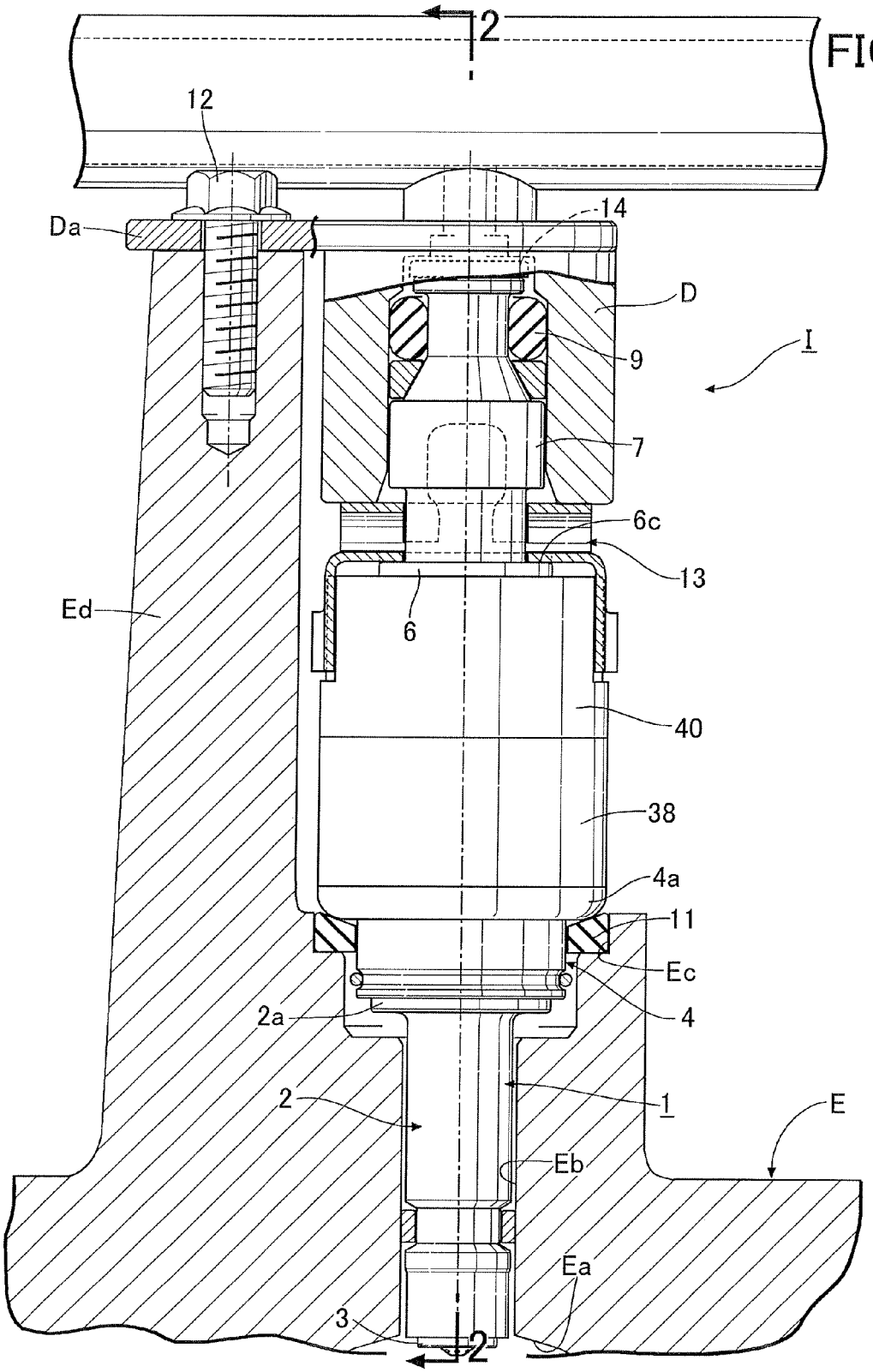
FIG. 1 is a front view illustrating an electromagnetic fuel injection valve according to an embodiment of the present invention, which is mounted in an engine.
Figure 2:
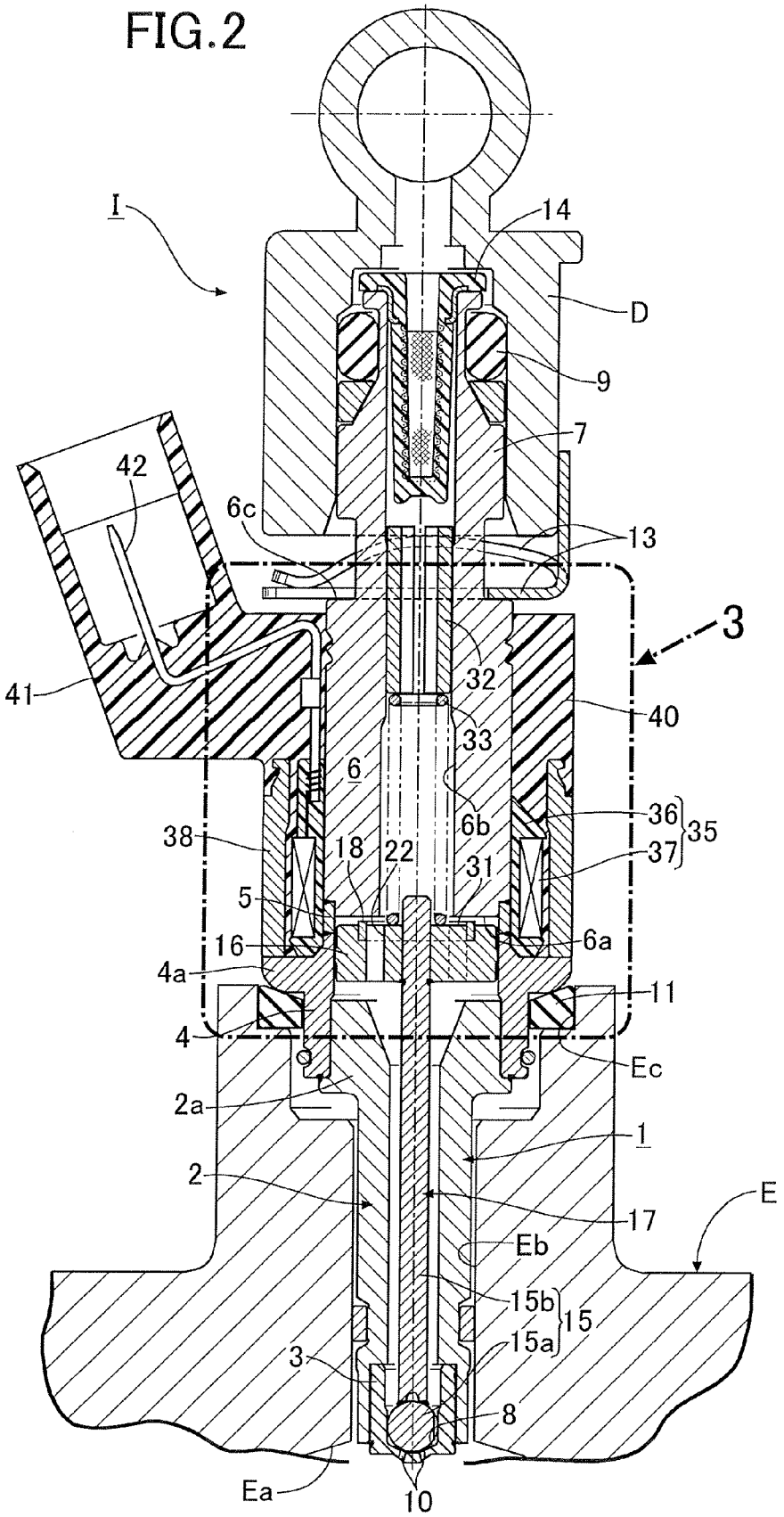
FIG. 2 is a sectional view taken along the 2-2 line in FIG. 1.

In FIGS. 1 and 2, a cylinder head E of an engine is provided with a mounting hole Eb opened to a combustion chamber Ea, and an electromagnetic fuel injection valve I is mounted in the mounting hole Eb. This fuel injection valve I is capable of injecting a fuel to the combustion chamber Ea. Here, in the fuel injection valve I, a fuel injection side is referred to as the front, whereas a fuel inlet side is referred to as the rear.

A valve housing 1 of the fuel injection valve I includes a valve housing body 2 made of a metal and formed in a hollow cylindrical shape, a valve seat member 3 formed in a bottomed cylindrical shape, and fitted and welded to an inner peripheral surface of a front end portion of the valve housing body 2, a magnetic cylindrical body 4 fitted and welded to an outer periphery of a large-diameter portion 2*a* at a rear end of the valve housing body 2, and a non-magnetic cylindrical body 5 made of a metal and coaxially connected to a rear end of the magnetic cylindrical body 4. A fixed core 6 is coaxially connected to a rear end of the non-magnetic cylindrical body 5, and a fuel inlet tube 7 is formed continuously from a rear end of the fixed core 6 in an integrated and coaxial manner. The fixed core 6 includes a hollow portion 6*b* communicating with an inside of the fuel inlet tube 7.

The magnetic cylindrical body 4 includes a flange-shaped yoke portion 4*a* formed integrally at an intermediate part thereof in an axial direction. This yoke portion 4*a* is supported by a load bearing hole Ec with a cushion member 11 interposed in between. The load bearing hole Ec surrounds an upper opening portion of the mounting hole Eb of the cylinder head E. Thus, the yoke portion 4*a* constitutes a first load bearing portion supported by the cylinder head E in the axial direction of the fuel injection valve I.

A fuel filter 14 is fitted in an inlet of the fuel inlet tube 7, and a fuel distribution pipe D to distribute a fuel under high pressure is fitted to an outer periphery of the fuel inlet tube 7 with a seal member 9 interposed in between. A resilient holding member 13 formed of a leaf spring is inserted between the fuel distribution pipe D and a rear end surface 6*c* of the fixed core 6. A bracket Da of the fuel distribution pipe D is fixed with a bolt 12 to a supporting portion Ed provided in the cylinder head E so that a predetermined set load (compression load) can be applied to the resilient holding member 13. Thus, the rear end surface 6*c* of the fixed core 6 constitutes a second load bearing portion supported by the resilient holding member 13 in the axial direction of the fuel injection valve I. In this structure, the fuel injection valve I is held between the cylinder head E and the resilient holding member 13 under the set load of the resilient holding member 13, and thereby withstands the high pressure of the combustion chamber Ea of the engine.

The valve seat member 3 is provided with a conical valve seat 8 at a front end wall thereof, and multiple fuel injection holes 10 opened near the center of the valve seat 8.

A valve assembly 17 including a valve body 15 and a movable core 16 is housed inside the valve housing 1 within a range from the valve seat member 3 to the non-magnetic cylindrical body 5. The valve body 15 includes a spherical valve portion 15*a* configured to open and close the fuel injection holes 10 in cooperation with the valve seat 8, and a valve stem 15*b* supporting the valve portion 15*a* and extending into a front end portion of the hollow portion 6*b* of the fixed core 6. The movable core 16 having a rear end surface opposed to the front end surface of the fixed core 6, namely the attraction surface 6*a*, is fitted and fixed to an outer peripheral surface of an intermediate part of the valve stem 15*b*.

The valve portion 15*a* is supported to be slidable on an inner peripheral surface of the valve seat member 3. An outer periphery of the valve portion 15*a* is formed to have multiple flat surfaces which allow passages of the fuel. On the other hand, the movable core 16 is supported to be slidable on an inner peripheral surface of the magnetic cylindrical body 4. Thus, the valve assembly 17 is supported at two positions of the valve seat member 3 and the magnetic cylindrical body 4 to be slidable in the axial direction.

A non-magnetic collar 18 is buried in the movable core 16 while protruding from the rear end surface of the movable core 16. A valve-opening stroke of the valve body 15 is regulated by contact of the collar 18 with the attraction surface 6*a* of the fixed core 6.

The movable core 16 is provided with multiple communication holes 22 that allow the hollow portion 6*b* of the fixed core 6 to communicate with the inside of the valve housing 1. The rear end surface of the movable core 16 around the valve stem 15*b* is used as a spring seat 31. A valve spring 33 which biases the movable core 16 in a closing direction of the valve body 15 is provided in a compressed state between the spring seat 31 and a pipe-shaped retainer 32 press-fitted in the hollow portion 6*b* of the fixed core 6. In this process, a set load of the valve spring 33 is adjusted by a fitting depth of the retainer 32 in the fixed core 6.

A coil assembly 35 is fitted to an outer peripheral surface ranging from the rear end portion of the magnetic cylindrical body 4 to the fixed core 6. The coil assembly 35 includes a bobbin 36 fitted to the outer peripheral surface and a coil 37 wound around the bobbin 36. A front end portion of a coil housing 38 housing the coil assembly 35 is placed on and welded to the yoke portion 4*a* of the magnetic cylindrical body 4.

Figure 3:
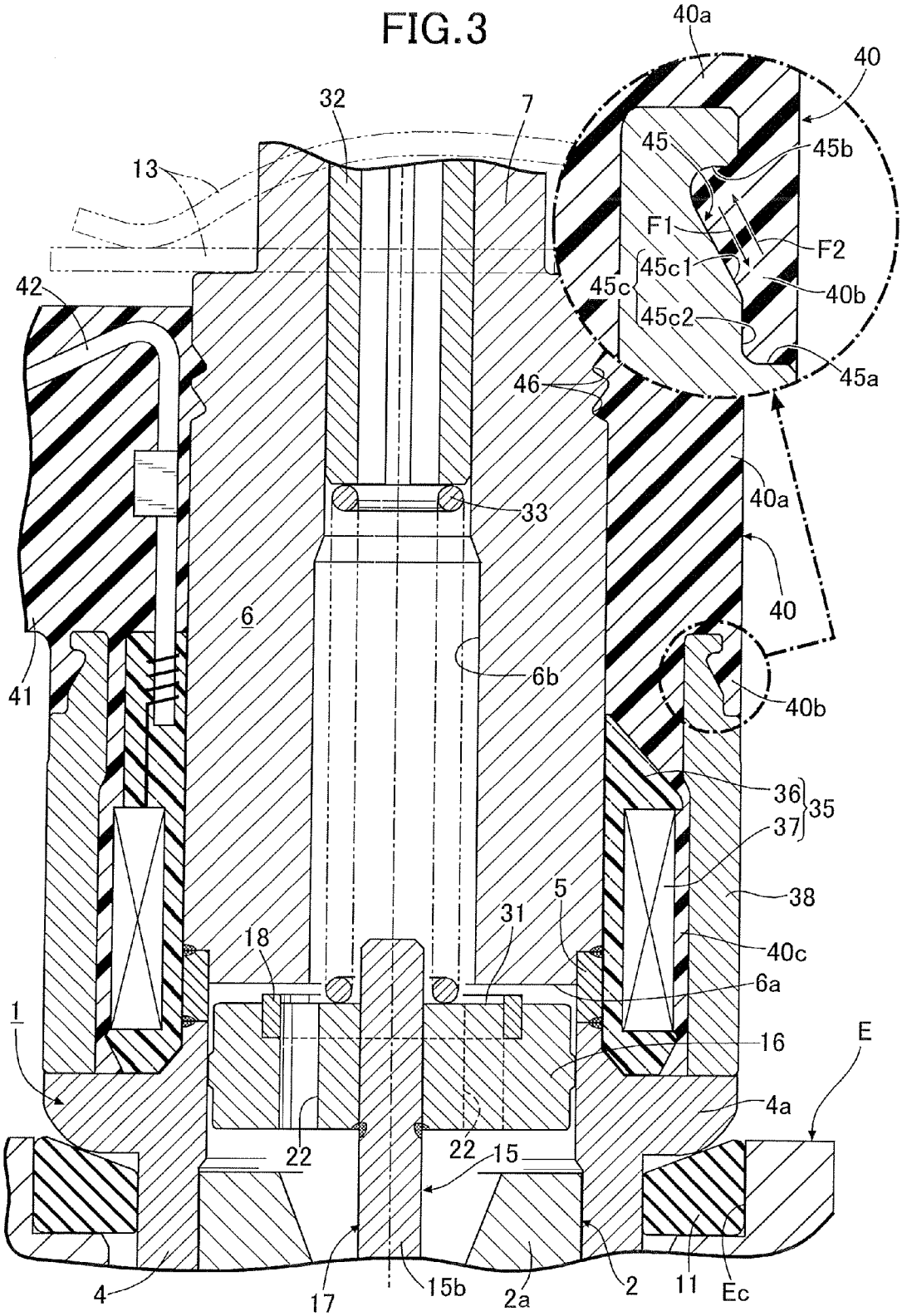
FIG. 3 is an enlarged view of the part 3 in FIG. 2.

As clearly illustrated in FIGS. 2 and 3, an annular anchor groove 45 is formed in an outer peripheral surface of a rear end portion of the coil housing 38. The anchor groove 45 includes a flat and annular front inner surface 45*a*, a flat and annular rear inner surface 45*b* having a smaller diameter than the front inner surface 45*a*, and an annular groove bottom 45*c* connecting the front and rear inner surfaces 45*a*, 45*b* to each other. The groove bottom 45*c* is formed to at least partially have a tapered surface 45*c*1 the diameter of which is increased toward the front. In the illustrated embodiment, the groove bottom 45*c* includes the tapered surface 45*c*1 continued from the rear inner surface 45*b* and a cylindrical surface 45*c*2 connecting a large-diameter portion of the tapered surface 45*c*1 to the front inner surface 45*a*. On the other hand, the outer peripheral surface of the fixed core 6 is formed to have multiple annular grooves 46. Then, a cover layer 40 made of a synthetic resin is formed by molding, to extend from the rear end portion of the coil housing 38 including the anchor groove 45 to the rear end portion of the fixed core 6 including the annular grooves 46, and to cover them. The cover layer 40 includes a first seal portion 40*a* formed in a thick cylindrical shape and bonded to the outer peripheral surface of the fixed core 6, a second seal portion 40*b* formed in a thin annular shape, continued from a front end of the first seal portion 40*a* and filled inside the anchor groove 45, and an insulation portion 40*c* continued from the front end of the first seal portion 40*a* and impregnated into the coil assembly 35.

In addition, a coupler 41 is formed integrally in the first seal portion 40*a*. The coupler 41 protrudes on one side of the first seal portion 40*a* and holds a terminal 42 connected to the coil 37.

Next, the operation of this embodiment is described.

When the coil 37 is not energized, the valve body 15 is pressed forward by the set load of the valve spring 33 and is seated on the valve seat 8 to close the fuel injection holes 10. In short, the valve body 15 is in a closed state and the movable core 16 keeps a predetermined gap with respect to the attraction surface 6*a* of the fixed core 6.

When the coil 37 is energized, magnetic flux generated by the coil 37 sequentially passes through the fixed core 6, the coil housing 38, the magnetic cylindrical body 4 and the movable core 16, and a magnetic force thereof attracts the movable core 16 to the attraction surface 6*a* of the fixed core 6 against the set load of the valve spring 33. Then, the non-magnetic collar 18 comes into contact with the attraction surface 6*a* and stops. In this process, the valve body 15 gets out of the valve seat 8 and turns into an opened state. When the valve body 15 is opened, a fuel fed under pressure to the fuel inlet tube 7 from a fuel pump not illustrated is directly injected to the combustion chamber Ea of the engine from the fuel injection holes 10 after passing through the inside of the pipe-shaped retainer 32, the hollow portion 6*b* of the fixed core 6, the communication holes 22 of the movable core 16, the inside of the valve housing 1, and the valve seat 8 in this order.

While the engine is in operation, the high pressure of the combustion chamber Ea acts as a load on the valve housing 1 to press the valve housing 1 rearward. This rearward load is supported by the set load of the resilient holding member 13 provided between the fixed core 6 and the fuel distribution pipe D, and the first and second load bearing portions 4*a*, 6*c* of the fuel injection valve I are held between the cylinder head E and the resilient holding member 13.

In this regard, the valve housing 1 and the fixed core 6 being entirely metallic members are present between the first and second load bearing portions 4*a*, 6*c*. Even when a high set load of the resilient holding member 13 continuously acts on these metallic members, the metallic members are unchanged in shape and thus the set load of the resilient holding member 13 is also unchanged. Hence, the fuel injection valve I can be supported stably for a long period of time.

The cover layer 40 made of the synthetic resin and formed by molding to extend from the rear end portion of the coil housing 38 to the rear end portion of the fixed core 6 includes the first seal portion 40*a* formed in the thick cylindrical shape and bonded to the outer peripheral surface of the fixed core 6, the second seal portion 40*b* formed in the thin annular shape, continued from the front end of the first seal portion 40*a* and filled inside the anchor groove 45, and the insulation portion 40*c* continued from the front end of the first seal portion 40*a* and making the coil assembly 35 impregnated therewith. Thus, the cover layer 40 can prevent rain water, cleaning water or the like from entering the coil 37 side from the outer peripheral surfaces of the coil housing 38 and the fixed core 6.

When the fixed core 6, the coil housing 38 and the cover layer 40 located around the coil 37 are repeatedly heated and cooled due to heat generation of the coil 37 during the operation of the engine and heat dissipation of the coil 37 during the outage of the engine, the cover layer 40 repeatedly expands and shrinks to a large extent because the cover layer 40 made of the synthetic resin has a different thermal expansion coefficient from those of the coil housing 38 and the fixed core 6 which are magnetic bodies. The first seal portion 40*a* of the cover layer 40, in particular, is thicker than the second seal portion 40*b* and accordingly expands and shrinks by larger amounts than the second seal portion 40*b*. Moreover, a contact area of the first seal portion 40*a* with the fixed core 6 is larger than a contact area of the second seal portion 40*b* with the coil housing 38. Thus, a bonding strength of the first seal portion 40*a* to the fixed core 6 is larger than a bonding strength of the second seal portion 40*b* to the coil housing 38. For these reasons, the expansion and shrinkage of the first seal portion 40*a* make the second seal portion 40*b* displaced.

The second seal portion 40*b* is located in the outer periphery of the front end portion of the first seal portion 40*a*. Thus, as illustrated in FIG. 3, a forward and outward force F1 is applied to the second seal portion 40*b* when the first seal portion 40*a* expands in the axial direction and radial directions, and a rearward and inward force F2 is applied to the second seal portion 40*b* when the first seal portion 40*a* shrinks in the axial direction and the radial directions.

The second seal portion 40*b* receiving these forces F1, F2 is in close contact with the tapered surface 45*c*1 of the groove bottom 45*c* of the annular anchor groove 45 of the coil housing 38. The tapered surface 45*c*1 is formed to have a diameter increased toward the front, and has a shape along the directions of the forces F1, F2. Thus, the tapered surface 45*c*1 and the second seal portion 40*b* can maintain their close contact state even when a slip occurs therebetween. For this reason, even when the second seal portion 40*b* forms a gap with respect to any one of the flat front and rear inner surfaces 45*a*, 45*b* of the anchor groove 45 due to the expansion and shrinkage of the first seal portion 40*a*, the tapered surface 45*c*1 of the groove bottom 45*c* and the second seal portion 40*b* maintain their close contact state, and therefore the second seal portion 40*b* can secure the sealing performance on the coil housing 38.

In addition, even though the second seal portion 40*b* is thinner and accordingly expands and shrinks by smaller amounts than the first seal portion 40*a*, the second seal portion 40*b* under a low temperature shrinks, increases the adhesion to the groove bottom 45*c* of the anchor groove 45 in the outer periphery of the coil housing 38, and thereby can enhance the sealing performance on the coil housing 38. Under a low temperature, in particular, the enhancement of the sealing performance of the second seal portion 40*b* is effective because adhered water drops tend not to evaporate.

The cover layer 40 as described above is formed on the outer peripheral surfaces of the coil housing 38 and the fixed core 6, is placed on inner sides of the first and second load bearing portions 4*a*, 6*c*, and thus does not receive the set load of the resilient holding member 13. Accordingly, the cover layer 40 is free from a deformation due to the set load, and is capable of securing the sealing performance on the coil hosing 38 and the fixed core 6 for a long period of time.

The present invention is not limited to the foregoing embodiment, but may be variously modified in design without departing from the gist of the present invention.

What is claimed is:

1. A support structure of a direct fuel injection valve comprising:

a valve housing including a valve seat at a front end thereof;

a yoke portion;

a fixed core made of a metal and provided to be connected to a rear end of the valve housing;

a fuel inlet tube continued from a rear end of the fixed core;

a movable core opposed to an attraction surface of a front end of the fixed core;

a coil provided around an outer periphery of the fixed core;

a valve body housed in the valve housing and configured to operate in cooperation with the valve seat;

a coil housing that houses the coil therein; and a cover layer made of a synthetic resin and formed by molding to extend from the coil housing to a part of the fixed core, the cover layer being integrally formed with a coupler, in which the fuel injection valve is configured such that in a state installed on a cylinder head of an engine, a fuel is directly injected to a combustion chamber of the engine when the valve body is opened with the coil energized to cause the fixed core to attract the movable core, wherein the yoke portion is made of a metal and is provided with a first load bearing portion, the first load bearing portion being not covered by the cover layer and configured to be supported by the cylinder head of the engine in an axial direction of the valve housing, the fixed core has a rear end portion which is not covered by the cover layer, the rear end portion being provided with a second load bearing portion not covered by the cover layers, the second load bearing portion having a planar portion which is configured to be abutted by and support in the axial direction, a resilient holding member which comprises a leaf spring, and the resilient holding member is provided between the second bearing portion and a fuel distribution pipe which is fitted to the fuel inlet tube and fixed to the cylinder head of the engine, and thus the first and second load bearing portions are held between the cylinder head of the engine and the resilient holding member, so that the resilient holding member applies a forward set load to the first and second bearing portions.

2. The support structure of a direct fuel injection valve according to claim 1, wherein the first load bearing portion is supported on the cylinder head of the engine with a cushion member interposed therebetween.

* * * * *